US006766752B2

(12) United States Patent
Chang

(10) Patent No.: US 6,766,752 B2
(45) Date of Patent: Jul. 27, 2004

(54) SEWING MACHINE HAVING A THREAD HOOKING DEVICE

(76) Inventor: Tseng Hsien Chang, 9Fl., No. 270, Gaugung Rd., Taichung (TW), 402

( * ) Notice: Subject to any disclaimer, the term of this patent is extended or adjusted under 35 U.S.C. 154(b) by 0 days.

(21) Appl. No.: 10/419,213

(22) Filed: Apr. 21, 2003

(65) Prior Publication Data

US 2004/0016380 A1 Jan. 29, 2004

(30) Foreign Application Priority Data

Jul. 25, 2002 (TW) ..... 91211574 U

(51) Int. Cl.[7] ..... D05B 61/00
(52) U.S. Cl. ..... 112/253; 112/286; 112/187
(58) Field of Search ..... 112/286, 124, 112/253, 187, 475.66, 166, 199

(56) References Cited

U.S. PATENT DOCUMENTS 3,424,115 A * 1/1969 Schopf ..... 112/296
5,025,739 A * 6/1991 Inoue ..... 112/286
5,383,414 A * 1/1995 Winter et al. ..... 112/162
6,021,727 A * 2/2000 Ku ..... 112/286
6,205,941 B1 * 3/2001 Yu ..... 112/286

* cited by examiner

*Primary Examiner*—Ismael Izaguirre
(74) *Attorney, Agent, or Firm*—Rosenberg, Klein & Lee

(57) ABSTRACT

A sewing machine includes a hook having a distal end formed with a thread hooking portion, and a thread hooking device mounted on the thread hooking portion of the hook. Thus, the thread hooking device includes a plurality of thread guide portions provided on the bottom of the thread hooking portion to draw a plurality of sewing threads of different patterns and colors, thereby enhancing the diversity of the sewing threads so as to satisfy the user's different requirements. In addition, the sewing threads can be introduced into the thread hooking portion rapidly and conveniently, thereby facilitating operation and replacement of the sewing threads.

11 Claims, 5 Drawing Sheets

SEWING MACHINE HAVING A THREAD HOOKING DEVICE

BACKGROUND OF THE INVENTION

1. Field of the Invention

The present invention relates to a sewing machine, and more particularly to a sewing machine having a thread hooking device.

2. Description of the Related Art

A conventional sewing machine in accordance with the prior art shown in FIG. 5 comprises a jaw member 90 having a distal end formed with a hook portion 93 for hooking and drawing one of a plurality of sewing threads 92. However, the hook portion 93 can only hook and draw a single sewing thread 92 at a time, so that the surface of the fabric only has a single pattern after the single sewing thread 92 is sewn, so that the pattern of the fabric lacks diversity and variation.

SUMMARY OF THE INVENTION

The present invention is to mitigate and/or obviate the disadvantage of the conventional sewing machine.

The primary objective of the present invention is to provide a sewing machine, wherein the thread hooking device includes a plurality of thread guide portions provided on the bottom of the thread hooking portion of the hook to draw a plurality of sewing threads of different patterns and colors, thereby enhancing the diversity of the sewing threads so as to satisfy the user's different requirements.

Another objective of the present invention is to provide a sewing machine, wherein the thread guide portions are sealed by the thread stop member, so that the sewing threads are received in a closed space and are operated rigidly and stably, thereby preventing the sewing threads from slipping during the sewing process, so as to enhance the sewing quality.

A further objective of the present invention is to provide a sewing machine, wherein the sewing threads can be introduced into the thread hooking portion of the hook rapidly and conveniently, thereby facilitating operation and replacement of the sewing threads.

In accordance with the present invention, there is provided a sewing machine, comprising:

a hook having a distal end formed with a thread hooking portion; and a thread hooking device mounted on the thread hooking portion of the hook.

Further benefits and advantages of the present invention will become apparent after a careful reading of the detailed description with appropriate reference to the accompanying drawings.

DETAILED DESCRIPTION OF THE INVENTION

Figure 1:
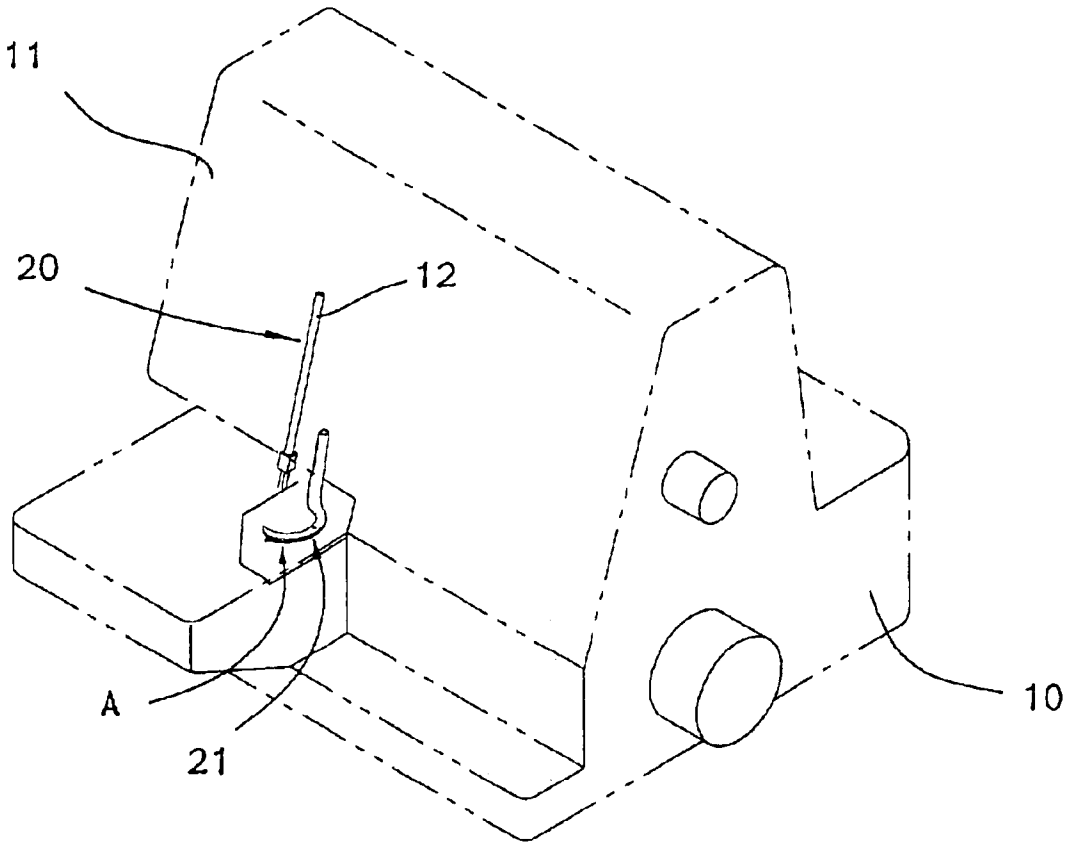
FIG. 1 is a perspective view of a sewing machine in accordance with the preferred embodiment of the present invention.
Figure 2:
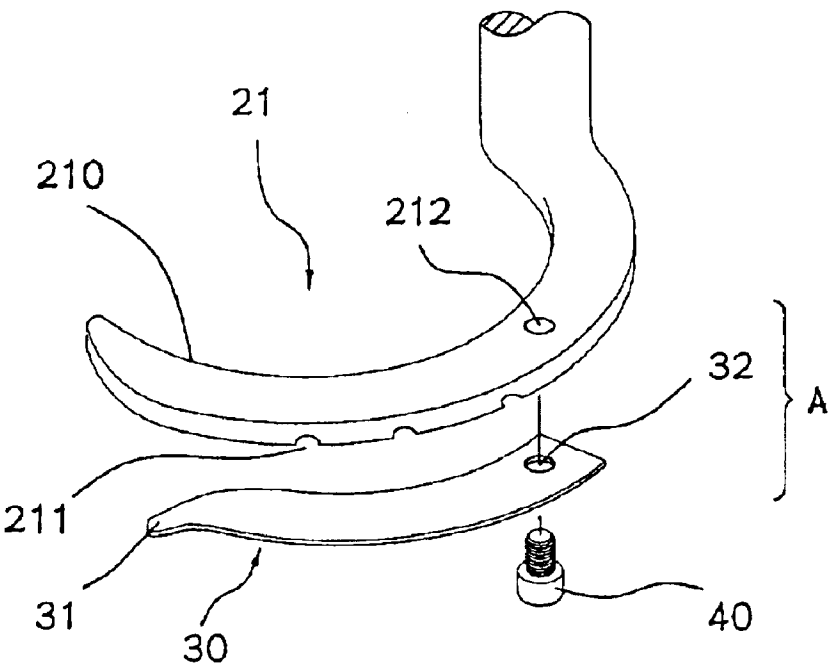
FIG. 2 is a partially exploded perspective view of the sewing machine in accordance with the preferred embodiment of the present invention.
Figure 3:
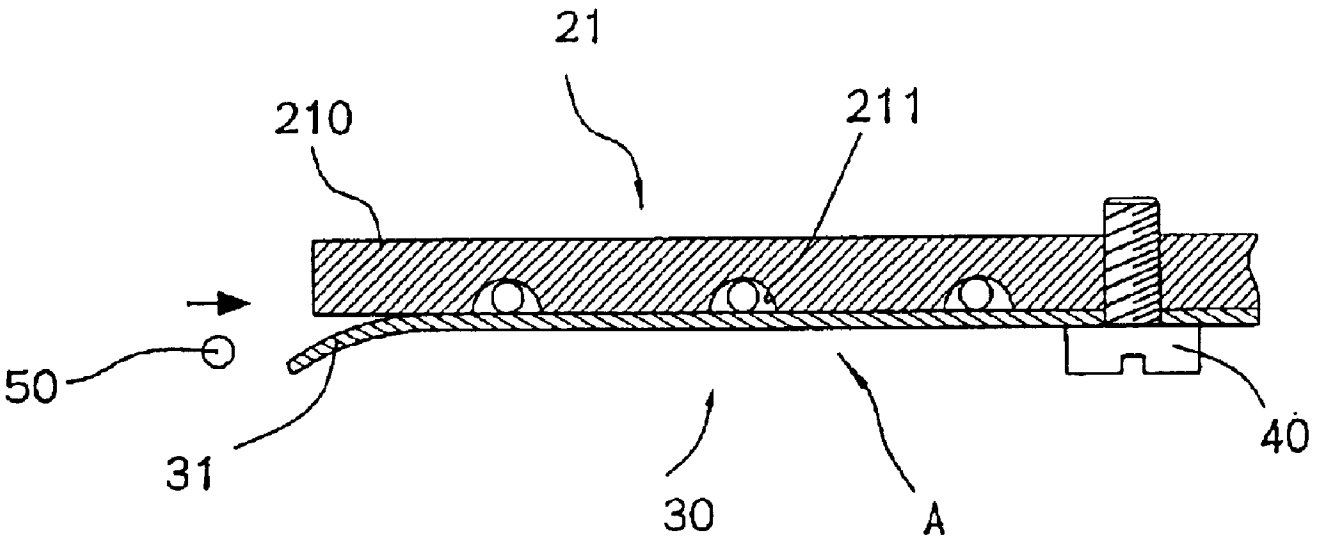
FIG. 3 is a side plan cross-sectional assembly view of the sewing machine as shown in FIG. 2.

Referring to the drawings and initially to FIGS. 1–3, a sewing machine 10 in accordance with the preferred embodiment of the present invention comprises a cantilever 11 having a free end provided with a needle bar 12 and a hook 21, and an operation mechanism 20 mounted on the cantilever 11 to operate the hook 21 which co-operates with the needle bar 12.

The hook 21 has a distal end formed with an arc-shaped thread hooking portion 210 directed toward the needle bar 12.

The sewing machine 10 further comprises a thread hooking device A mounted on the thread hooking portion 210 of the hook 21. Preferably, the thread hooking device A has a separate structure.

The thread hooking device A includes a plurality of thread guide portions 211 formed in a bottom of the thread hooking portion 210 of the hook 21, and a thread stop member 30 mounted on the bottom of the thread hooking portion 210 of the hook 21 to seal the thread guide portions 211. Preferably, each of the thread guide portions 211 is a semi-circular opening 211. Preferably, the thread stop member 30 is an elastic sheet plate. The thread stop member 30 has a first end formed with a bent thread inlet end 31.

In addition, the thread hooking portion 210 of the hook 21 has an end formed with a fixing portion 212, the thread stop member 30 has a second end formed with a fixing portion 32, and the thread hooking device A further includes a fixing member 40 extended through the fixing portion 32 of the thread stop member 30 and secured in the fixing portion 212 of the thread hooking portion 210 of the hook 21, thereby fixing the thread stop member 30 on the bottom of the thread hooking portion 210 of the hook 21.

Preferably, the fixing portion 32 of the thread stop member 30 is a through hole, the fixing portion 212 of the thread hooking portion 210 of the hook 21 is a screw bore, and the fixing member 40 is a bolt.

Thus, as shown in FIG. 3, the sewing threads 50 can be introduced into a gap formed between the thread hooking portion 210 of the hook 21 and the thread stop member 30 through the thread inlet end 31 of the thread stop member 30 and can then be inserted into the respective thread guide portions 211, so that the sewing threads 50 can be introduced into the thread hooking portion 210 of the hook 21 rapidly and conveniently.

Accordingly, the a sewing machine 10 in accordance with the present invention has the following advantages.

1. The thread hooking device A includes a plurality of thread guide portions 211 provided on the bottom of the thread hooking portion 210 of the hook 21 to draw a plurality of sewing threads 50 of different patterns and colors, thereby enhancing the diversity of the sewing threads 50 so as to satisfy the user's different requirements.

2. The thread guide portions 211 are sealed by the thread stop member 30, so that the sewing threads 50 are received in a closed space and are operated rigidly and stably, thereby preventing the sewing threads 50 from slipping during the sewing process, so as to enhance the sewing quality.

3. The sewing threads 50 can be introduced into the thread hooking portion 210 of the hook 21 rapidly and conveniently, thereby facilitating operation and replacement of the sewing threads 50.

Figure 4:
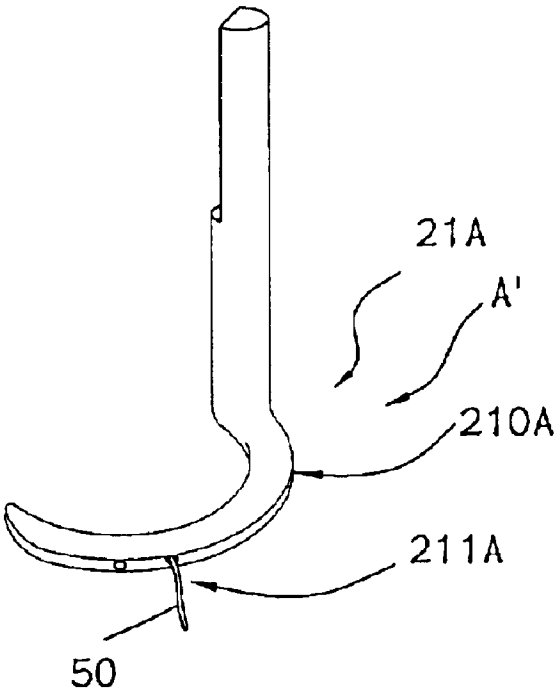
FIG. 4 is a perspective view of the sewing machine in accordance with another embodiment of the present invention.
Figure 5:
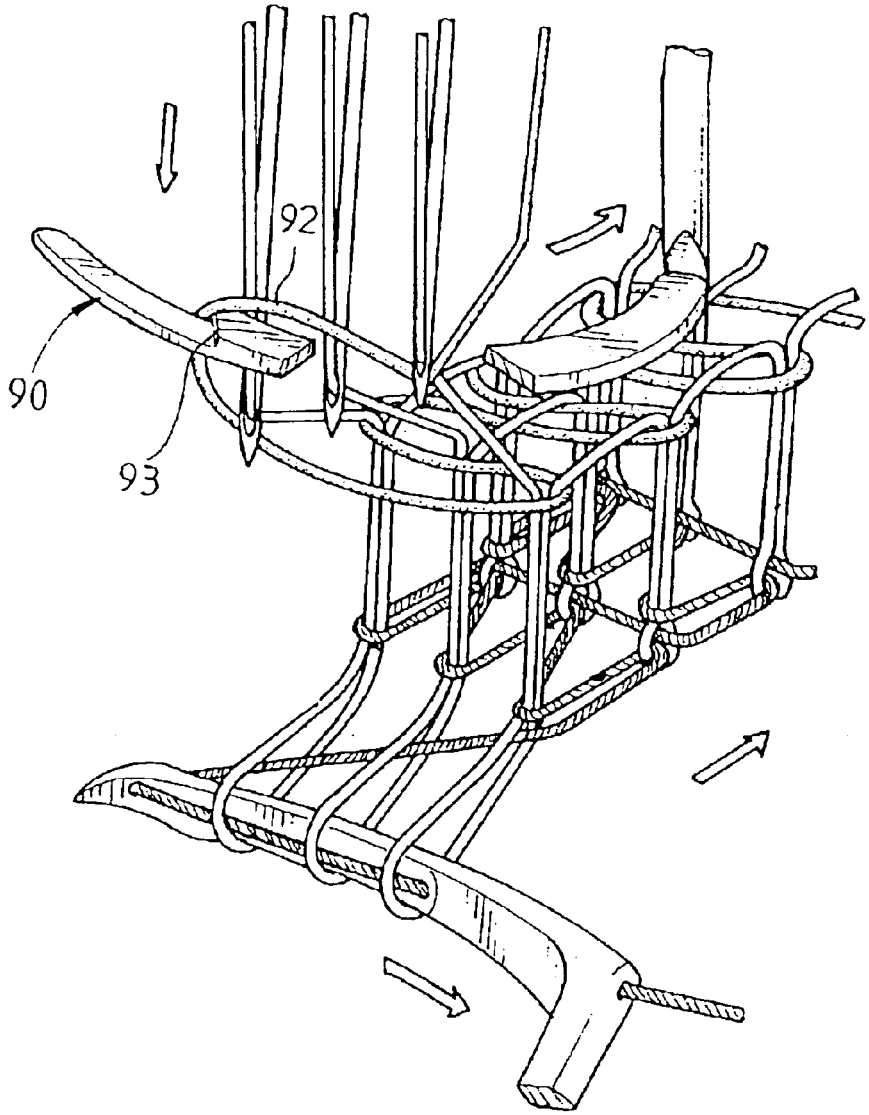
FIG.5 PRIOR ART
FIG. 5 is a perspective view of a conventional sewing machine in accordance with the prior art.

Referring to FIG. 4, the sewing machine in accordance with another embodiment of the present invention is shown, wherein the thread hooking device A' is integrally provided on the thread hooking portion 210A of the hook 21A. Preferably, the thread hooking device A' includes a plurality of thread guide portions 211A formed in the thread hooking portion 210A of the hook 21A. Preferably, each of the thread guide portions 211A is a through hole extended through the thread hooking portion 210A of the hook 21A. Thus, each of the sewing threads 50 is extended through and guided by a respective one of the thread guide portions 211A.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sewing machine, comprising:

a hook having a distal end formed with a thread hooking portion; and a thread hooking device mounted on the thread hooking portion of the hook, the thread hooking device including at least one thread guide portion formed in a surface of the thread hooking portion of the hook.

2. The sewing machine in accordance with claim 1, wherein each of the thread guide portions is a semi-circular opening.

3. The sewing machine in accordance with claim 1, wherein the thread hooking device further includes a thread stop member mounted on the bottom of the thread hooking portion of the hook to seal the at least one thread guide portion.

4. The sewing machine in accordance with claim 3, wherein the thread stop member is an elastic sheet plate.

5. The sewing machine in accordance with claim 3, wherein the thread stop member has a first end formed with a bent thread inlet end.

6. The sewing machine in accordance with claim 3, wherein the thread hooking portion of the hook has an end formed with a fixing portion, the thread stop member has a second end formed with a fixing portion, and the thread hooking device further includes a fixing member extended through the fixing portion of the thread stop member and secured in the fixing portion of the thread hooking portion of the hook, thereby fixing the thread stop member on the bottom of the thread hooking portion of the hook.

7. The sewing machine in accordance with claim 6, wherein the fixing portion of the thread stop member is a through hole, the fixing portion of the thread hooking portion of the hook is a screw bore, and the fixing member is a bolt.

8. The sewing machine in accordance with claim 5, further comprising a plurality of sewing threads introduced into a gap formed between the thread hooking portion of the hook and the thread stop member through the thread inlet end of the thread stop member and respectively inserted into a corresponding number of thread guide portions.

9. The sewing machine a hook having a distal end formed with a thread hooking portion; and a thread hooking device mounted on the thread hooking portion of the hook, the thread hooking device being integrally provided on the thread hooking portion of the hook, the thread hooking device including a plurality of thread guide portions formed in the thread hooking portion of the hook.

10. The sewing machine in accordance with claim 9, wherein each of the thread guide portions is a through hole extended through the thread hooking portion of the hook.

11. The sewing machine in accordance with claim 9, further comprising a plurality of sewing threads extended through and guided by a respective one of the thread guide portions.

* * * * *